US006006372A

United States Patent [19]

Chang

[11] Patent Number: 6,006,372

[45] Date of Patent: Dec. 28, 1999

[54] RINSING APPARATUS FOR TOILET

[76] Inventor: Tsung-Jen Chang, No. 250, Shi-Hwu Rd., Ta-Li City, Taichung, Taiwan

[21] Appl. No.: 09/195,175

[22] Filed: Nov. 17, 1998

[30] Foreign Application Priority Data

Feb. 5, 1998 [TW] Taiwan ..... 87201801

[51] Int. Cl.[6] ..... E03D 9/08

[52] U.S. Cl. ..... 4/420.2; 4/420.4; 4/447

[58] Field of Search ..... 4/420.2, 420.4, 4/447, 448

[56] References Cited

U.S. PATENT DOCUMENTS 4,995,121 2/1991 Barker ..... 4/447 X 5,063,618 11/1991 Souka ..... 4/420.4

*Primary Examiner*—Robert M. Fetsuga

*Attorney, Agent, or Firm*—Pro-Techtor International Services

[57] ABSTRACT

A rinsing apparatus installed in a toilet and controlled to rinse the user's buttocks, including a cartoon-figured main unit installed in the bowl of the toilet and controlled by a control valve therein to let rinsing water/cleaning solution (perfume) pass from a water inlet through water pressure buffering waiter holes to a spray nozzle via a water pipe.

3 Claims, 5 Drawing Sheets

RINSING APPARATUS FOR TOILET

BACKGROUND OF THE INVENTION

The present invention relates to a rinsing apparatus used in a toilet for rinsing the user's buttocks, and more particularly to a mechanical design of rinsing apparatus which has means to buffer the pressure of water so that supplied water is maintained at a constant pressure.

Regular rinsing apparatus for toilet are commonly operated by means of the control of a microprocessor. When a rinsing apparatus is operated, a metered volume of water is sprayed out of a spray nozzle. These conventional microprocessor-controlled rinsing apparatus are expensive, and consume much electric energy during operation. There are known mechanical rinsing apparatus for toilet. These mechanical rinsing apparatus do not consume electric energy during operation, however they commonly have a complicated structure. Furthermore, the installation of these conventional mechanical rinsing apparatus is not an easy job.

SUMMARY OF THE INVENTION

It is one object of the present invention to provide a rinsing apparatus for toilet, which can be manually controlled to spray jets of water subject to the desired length of time. It is another object of the present invention to provide a rinsing apparatus for toilet, which is a mechanical design. It is still another object of the present invention to provide a rinsing apparatus for toilet, which has a simple structure, and is durable and convenient in use. To achieve these and objects of the present invention, there is provided a rinsing apparatus installed in a toilet and controlled to rinse the user's buttocks, the rinsing apparatus comprising a main unit installed in the bowl of the toilet, the main unit comprising a base, and a control valve mounted in the base, the base comprising an outer shell, an inner wall, and a mounting plate integral with the periphery of the outer shell and installed in the bowl of the toilet, the inner wall having a plurality of water holes, the outer shell comprising at least one water inlet respectively connected to liquid supply means, and a water outlet disposed in communication with the at least one water inlet through the air holes, the control valve comprising a valve cap covered on the inner wall of the base at a top side, a flexible valve rod sheath suspended in the inner wall, a valve rod inserted through a hole on the valve cap into the valve rod sheath, a compression spring mounted around the valve rod inside the flexible valve rod sheath, and a control handle pivoted to one end of the valve rod outside the valve cap, the compression spring imparting a downward pressure to the valve rod and the valve rod sheath, the valve rod and the valve rod sheath being forced downwards by the compression spring to stop the water outlet when the control handle is turned to a vertical position in longitudinal alignment with the valve rod, the control handle having a first chamfered bottom edge and a second chamfered bottom edge bilaterally disposed at a bottom side thereof, the control handle being turned between a first position where the first chamfered bottom edge is stopped at the valve cap and the valve rod sheath is lifted with the valve rod from the water outlet to let the water outlet be fully opened, a second position where the control handle is disposed in a vertical position in longitudinal alignment with the valve rod and the valve rod sheath with the valve rod are forced downwards by the compression spring to stop the water outlet, and a third position where the second chamfered bottom edge is stopped at the valve rod and the valve rod sheath is lifted with the valve rod from the water outlet to let the water outlet be partially opened; a water tube having a first end connected to the water outlet of the main unit and a second end; and a spray nozzle assembly, the spray nozzle assembly comprising a mounting device fixedly fastened to the toilet seat of the toilet at a bottom side, a barrel fixedly connected to the mounting device, the barrel having water input end and a water output end, a fitting connected between the second end of the water tube and the water input end of the barrel, and a spray nozzle mounted on the water output end of the barrel, the spray nozzle comprising a circular center jet nozzle and a plurality of oblique jet nozzles equiangularly spaced around the circular center jet nozzle.

DETAILED DESCRIPTION OF THE PREFERRED EMBODIMENT

Figure 1:
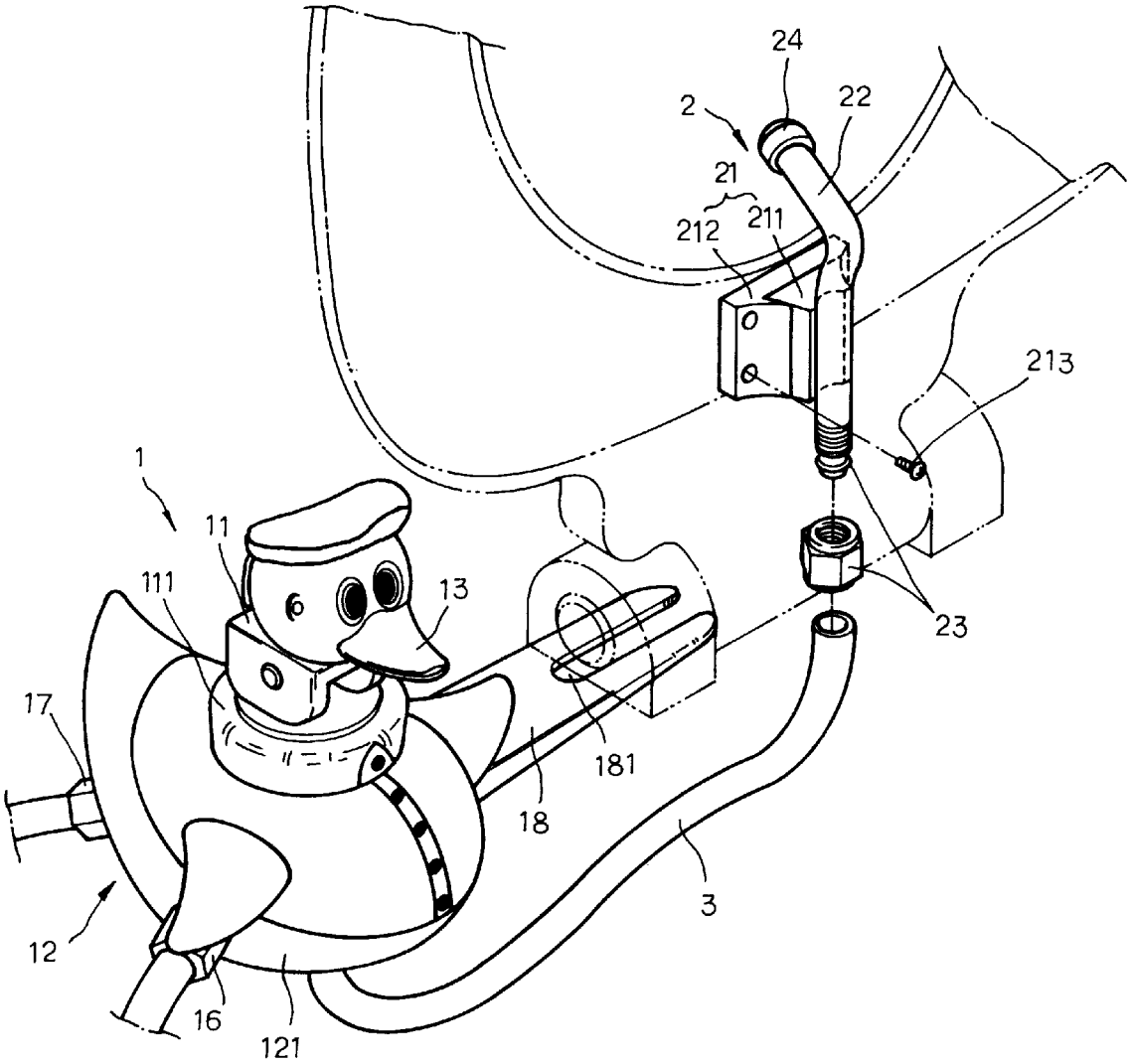
FIG. 1 is a perspective view of a rinsing apparatus according to the present invention.
Figure 2:
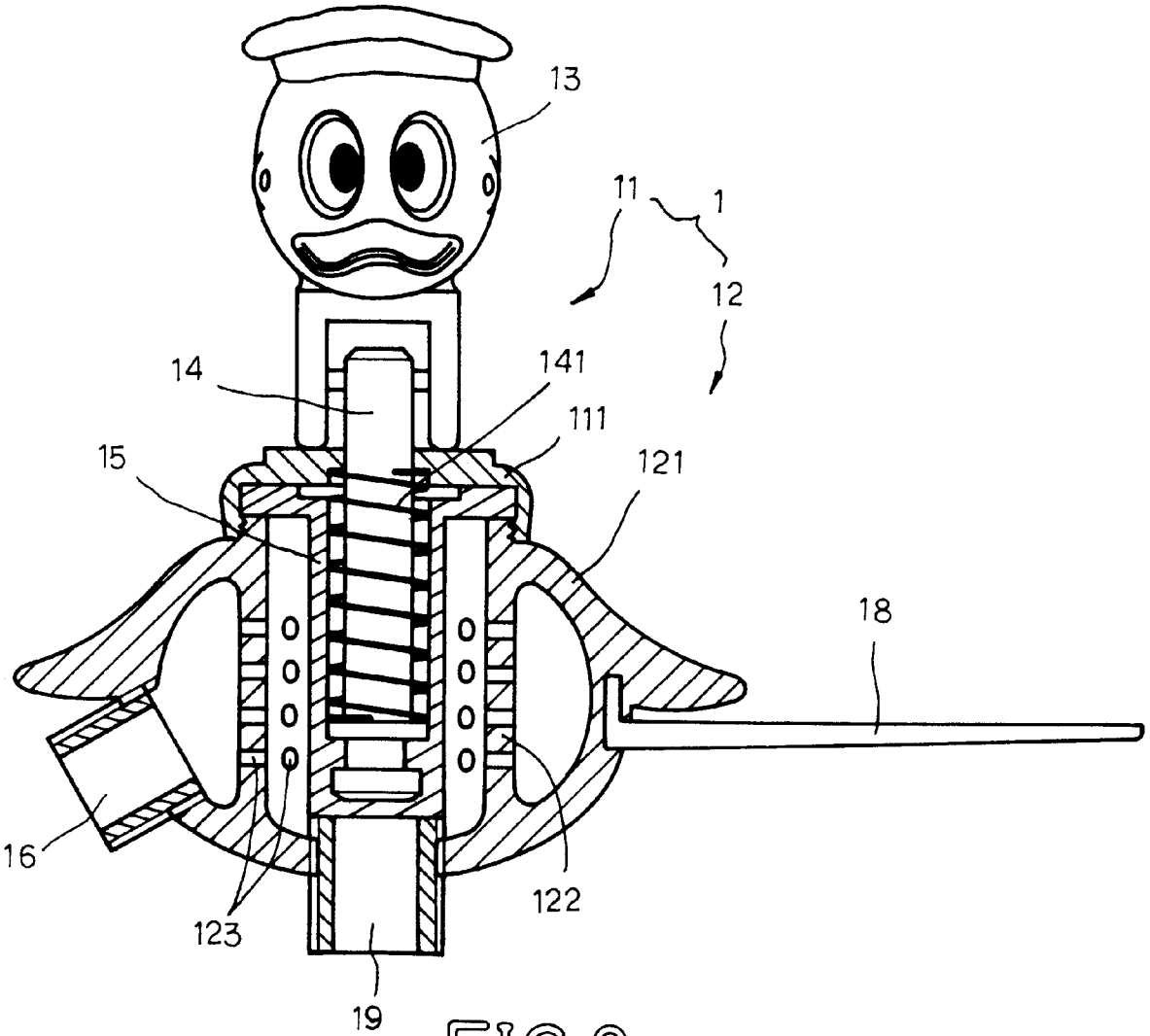
FIG. 2 is a front view in section of the main unit of the rinsing apparatus according to the present invention.
Figure 3:
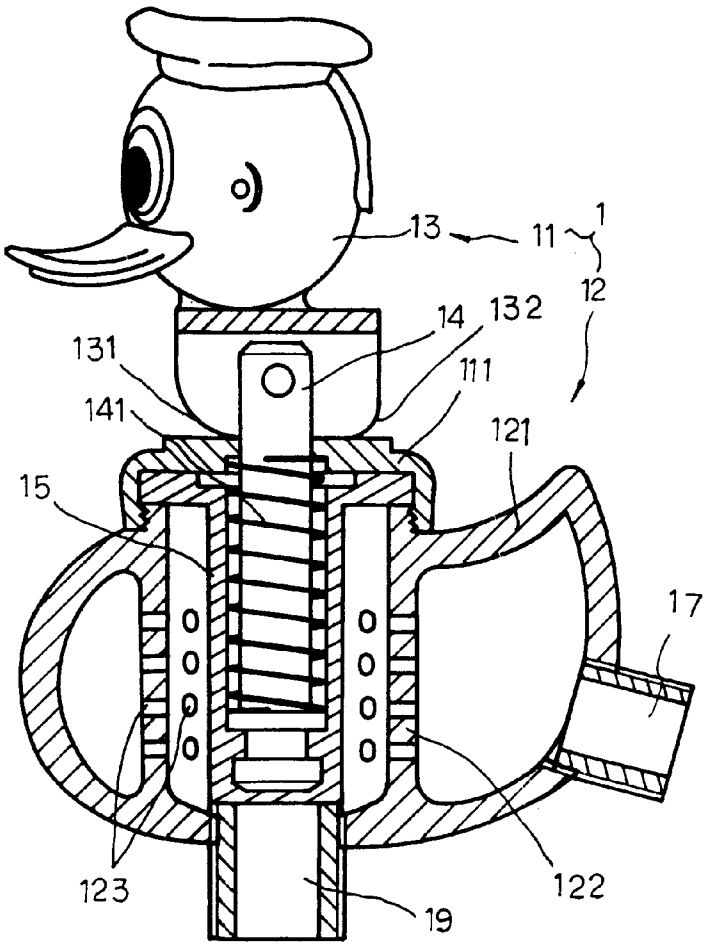
FIG. 3 is a side view in section of the main unit of the rinsing apparatus according to the present invention.

Referring to FIGS. 1, 2 and 3, a rinsing apparatus in accordance with the present invention is generally comprised of a main unit 1, a spray nozzle assembly 2, and a water tube 3 connected between the main unit 1 and the spray nozzle assembly 2.

The main unit 1 comprises a base 12, and a control valve 11 fastened to the base 12 by a screw joint. The control valve 11 comprises a flexible valve rod sheath 15 suspended in the base 12, a valve rod 14 inserted through a hole on a valve cap 111 into the valve rod sheath 15, a compression spring 141 mounted around the valve rod 14 inside the flexible valve rod sheath 15, and a control handle 13 pivoted to one end namely the top end of the valve rod 14 outside the valve cap 11. The control handle 13 has a first chamfered bottom edge 131 and a second chamfered bottom edge 132 bilaterally disposed at the bottom side thereof. The base 12 comprises an outer shell 121, an inner wall 122, and a mounting plate 18 integral with the periphery of the outer shell 121. The inner wall 122 defines a holding space, which holds the flexible valve rod sheath 15 on the inside, and has a plurality of water holes 123. The outer shell 121 comprises a first water inlet 16, a second water inlet 17, and a water outlet 19 connected to the spray nozzle assembly 2 through the water tube 3. The water outlet 19 is disposed in communication with the first water inlet 16 and the second water inlet 17 through the air holes 123. The first water inlet 16 is connected to a cold water source for example a city water supply system. The second water inlet 17 is connected to a warm water source or chemical solution source. The mounting plate 18 has a mounting hole 181 at one end for fastening to the hinge of the toilet set or a part of the bowl of the toilet. Further, the compression spring 141 imparts a downward pressure to the valve rod 14 and the flexible valve rod sheath 15, causing the valve rod sheath 15 to close the passage of the water outlet 19.

Figure 5:
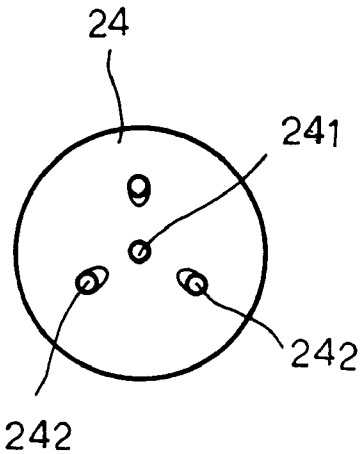
FIG. 5 is a front view in an enlarged scale of the spray nozzle of the spray nozzle assembly according to the present invention.

Referring to FIG. 5 and FIG. 1 again, the spray nozzle assembly 2 comprises a mounting device 21, which is fastened to the toilet seat, a barrel 22 fixedly connected to the mounting device 21, a fitting 23, which connects the barrel 22 to the water tube 3, and a spray nozzle 24 mounted on one end of the barrel 22 remote from the fitting 23. The mounting device 21 comprises a mounting block 211 integral with the periphery of the barrel 22, and a mounting plate 212. The mounting plate 212 may be eliminated, and the mounting block 211 can be directly adhered to the bottom sidewalk of the toilet seat. Alternatively, the mounting block 211 can be used with the mounting plate 212. When both the mounting block 211 and the mounting plate 212 are used, the mounting plate 212 is fixedly fastened to the bottom side wall of the toilet seat by screws 213, and then the mounting block 211 is adhered to the mounting plate 212. The spray nozzle 24 comprises a circular center jet nozzle 241 and a plurality of oblique jet nozzles 242 equiangularly spaced around the circular center jet nozzle 241.

Referring to FIGS. 2 and 3 again, when the control handle 13 is turned to a vertical position in longitudinal alignment with the valve rod 14, the valve rod 14 is forced downwards by the compression spring 141, thereby causing the water outlet 19 to be stopped by the valve rod sheath 15.

Figure 4:
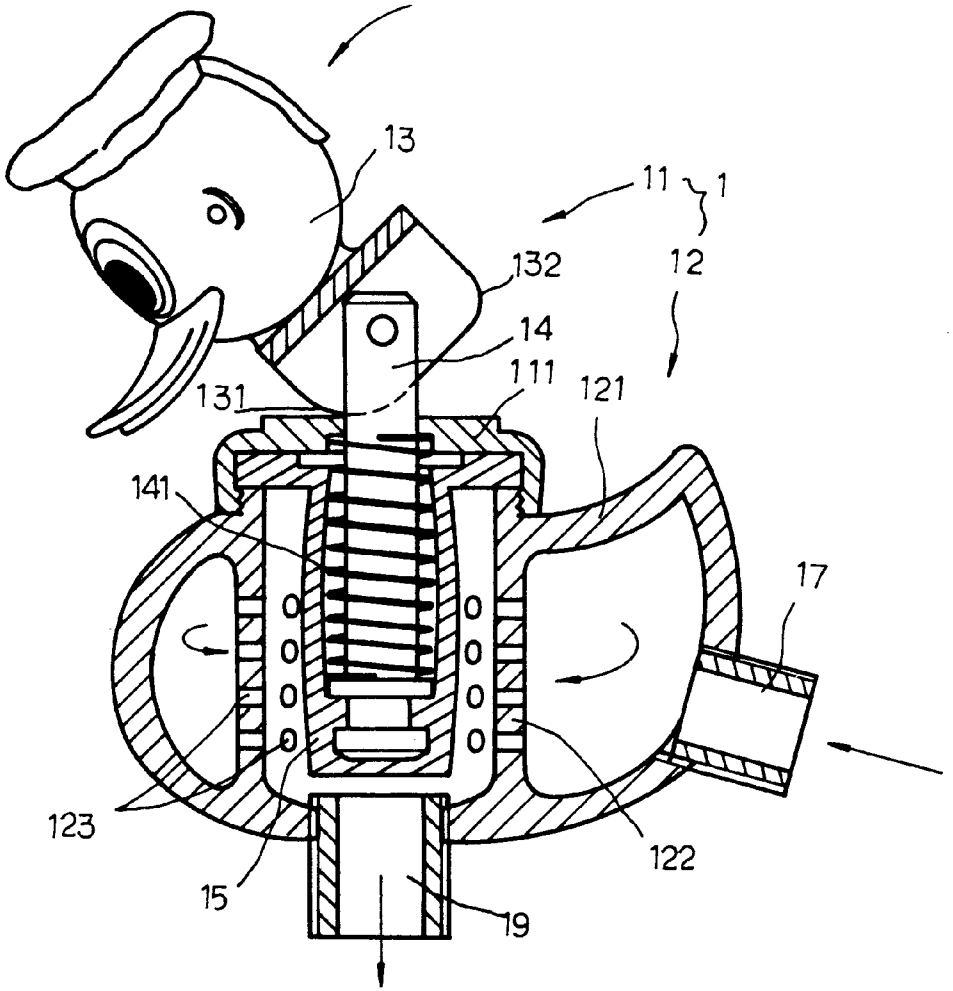
FIG. 4 is a schematic drawing showing the first chamfered edge of the control handle stopped at the valve cap, the water outlet opened, and water passed through the base according to the present invention.
Figure 6:
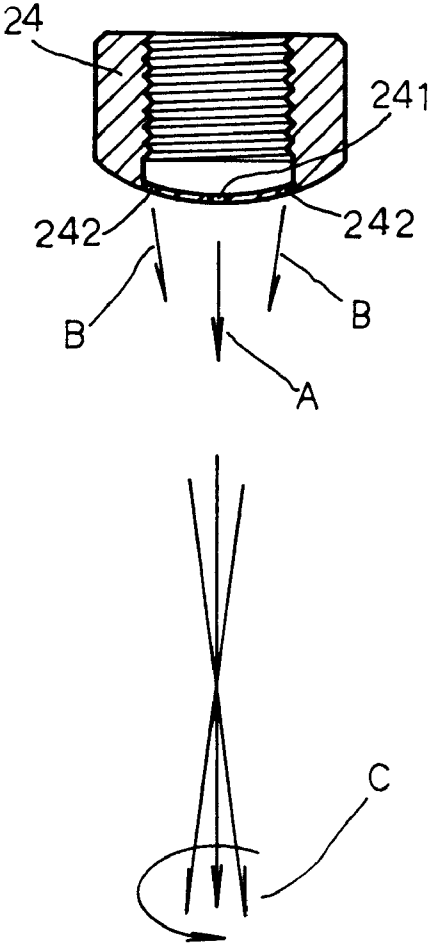
FIG. 6 is a schematic drawing showing jets of water spurted from the jet nozzles and gathered into a spiral stream of water.

Referring to FIG. 4 and FIG. 1 again, when the control handle 13 is turned downwards with the first chamfered bottom edge 131 or the second chamfered bottom edge 132 stopped at the valve cap 111, the valve rod 14 and the valve rod sheath 15 are lifted from the water outlet 19, causing the compression spring 141 to be compressed and the water outlet 19 to be opened, therefore water or chemical solution passes from the water inlet 16 or 17 through the water holes 123 and the water outlet 19 to the spray nozzle assembly 2 via the water tube 3. When water passes through the water holes 123 to the water outlet 19, its pressure is maintained in a stable condition. When water passes to the spray nozzle 24, jets of water spurted from the jet nozzles 241,242, and then gathered into a spiral stream of water C for rinsing the user's buttocks. Further, when the control handle 13 is turned downwardly forwards for permitting the first chamfered edge 131 to be stopped at the valve cap 111, the water outlet 19 is fully opened to achieve a high water flow rate. When the control handle 13 is turned downwardly backwards for permitting the second chamfered edge 132 to be stopped at the valve cap 111, the water outlet 19 is partially opened to achieve a low water flow rate.

Referring to FIG. 1 again, the main unit 1 can have any of a variety of designs, for example, the main unit 1 can be shaped like an animal, a cartoon figure, etc.

While only one embodiment of the present invention has been shown and described, it will be understood that various modifications and changes could be made thereunto without departing from the spirit and scope of the invention disclosed.

What the invention claimed is:

1. A rinsing apparatus installed in a toilet and controlled to rinse the user's buttocks, comprising:

a main unit installed in the bowl of the toilet, said main unit comprising a base, and a control valve mounted in said base, said base comprising an outer shell, an inner wall, and a mounting plate integral with the periphery of said outer shell and installed in the bowl of the toilet, said inner wall having a plurality of water holes, said outer shell comprising at least one water inlet respectively connected to liquid supply means, and a water outlet disposed in communication with said at least one water inlet through said air holes, said control valve comprising a valve cap covered on said inner wall of said base at a top side, a flexible valve rod sheath suspended in said inner wall, a valve rod inserted through a hole on said valve cap into said valve rod sheath, a compression spring mounted around said valve rod inside said flexible valve rod sheath, and a control handle pivoted to one end of said valve rod outside said valve cap, said compression spring imparting a downward pressure to said valve rod and said valve rod sheath, said valve rod and said valve rod sheath being forced downwards by said compression spring to stop said water outlet when said control handle is turned to a vertical position in longitudinal alignment with said valve rod, said control handle having a first chamfered bottom edge and a second chamfered bottom edge bilaterally disposed at a bottom side thereof, said control handle being turned between a first position where said first chamfered bottom edge is stopped at said valve cap and said valve rod sheath is lifted with said valve rod from said water outlet to let said water outlet be fully opened, a second position where said control handle is disposed in a vertical position in longitudinal alignment with said valve rod and said valve rod sheath with said valve rod are forced downwards by said compression spring to stop said water outlet, and a third position where said second chamfered bottom edge is stopped at said valve rod and said valve rod sheath is lifted with said valve rod from said water outlet to let said water outlet be partially opened;

a water tube having a first end connected to the water outlet of said main unit and a second end; and a spray nozzle assembly, said spray nozzle assembly comprising a mounting device fixedly fastened to the toilet seat of the toilet at a bottom side, a barrel fixedly connected to said mounting device, said barrel having a water input end and a water output end, a fitting connected between the second end of said water tube and the water input end of said barrel, and a spray nozzle mounted on the water output end of said barrel, said spray nozzle comprising a circular center jet nozzle and a plurality of oblique jet nozzles equiangularly spaced around said circular center jet nozzle.

2. The rinsing apparatus of claim 1 wherein said main unit has a peripheral design shaped like a cartoon figure.

3. The rinsing apparatus of claim 1 wherein the outer shell of said main unit comprises a first water inlet connected to a water source for guiding running water to said water outlet, and a second water inlet connected to a chemical solution source for guiding a chemical solution to said water outlet.

* * * * *